US006755653B2

(12) United States Patent
Varshneya

(10) Patent No.: US 6,755,653 B2
(45) Date of Patent: Jun. 29, 2004

(54) SYSTEM AND METHOD FOR PREVENTING CHEATING IN A SIMULATED COMBAT EXERCISE

(75) Inventor: Deepak Varshneya, Del Mar, CA (US)

(73) Assignee: Cubic Defense Systems, Inc., San Diego, CA (US)

( * ) Notice: Subject to any disclaimer, the term of this patent is extended or adjusted under 35 U.S.C. 154(b) by 232 days.

(21) Appl. No.: 10/027,890

(22) Filed: Oct. 25, 2001

(65) Prior Publication Data

US 2003/0082501 A1 May 1, 2003

(51) Int. Cl.[7] ..... F41G 3/26
(52) U.S. Cl. ..... 434/22; 434/19; 434/16
(58) Field of Search ..... 434/11–16, 19, 434/22, 27, 307 R, 308, 365; 463/2, 49–57; 356/43, 73, 239.7, 301, 394, 437; 250/305, 339.15

(56) References Cited

U.S. PATENT DOCUMENTS 4,405,234 A * 9/1983 Juaire ..... 356/239.7
4,568,183 A * 2/1986 Douglas ..... 356/43
4,784,486 A * 11/1988 Van Wagenen et al. ..... 356/301
5,426,295 A 6/1995 Parikh et al.
5,476,385 A 12/1995 Parikh et al.
5,767,976 A * 6/1998 Ankerhold et al. ..... 356/437
5,812,270 A * 9/1998 Hampton et al. ..... 356/394
5,929,981 A * 7/1999 Keilbach ..... 356/73
6,064,064 A * 5/2000 Castleman ..... 250/339.15
6,254,394 B1 7/2001 Draper et al.
6,386,879 B1 * 5/2002 Varshneya et al. ..... 434/16
6,545,272 B1 * 4/2003 Kondo ..... 250/305

* cited by examiner

*Primary Examiner*—Joe H. Cheng

(57) ABSTRACT

Soldiers and vehicles are fitted with infrared laser detectors for detecting simulated laser bullets and artillery shells from SAT-equipped small arms weapons and tanks employing laser scanner transmitters. An infrared LED is mounted inside the protective housing which supports each laser detector for illuminating the exterior surface of a window, lens or other transparent optical element positioned in front of the detector. Dirt, dust, mud, snow, shoe polish or other contaminant on the exterior surface of the optical element scatters the infrared radiation from the LED and in accordance with a test periodically performed by a test circuit, if the scattered signal exceeds a predetermined threshold value, a visual and/or audible warning is given to the player. If the optical element is not cleaned within a predetermined time after the warning, a kill command is executed to prevent the player from cheating.

19 Claims, 3 Drawing Sheets

SYSTEM AND METHOD FOR PREVENTING CHEATING IN A SIMULATED COMBAT EXERCISE

FIELD OF THE INVENTION

The present invention relates to military training equipment, and more particularly, to an improved system and method for processing signals from laser detectors worn by soldiers and carried by vehicles in simulated in war games.

BACKGROUND OF THE INVENTION

For many years the U.S. Army has trained soldiers with a multiple integrated laser engagement system (MILES). One aspect of MILES involves a small arms laser transmitter (SAT) being affixed to the stock of a small arms weapon such as an M16A1 rifle or a machine gun. Each soldier is fitted with detectors on his or her helmet and on a body harness adapted to detect a infrared laser "bullet" hit. The soldier pulls the trigger of his or her weapon to fire a blank or blanks to simulate the firing of an actual round or multiple rounds. An audio sensor or a photo-optic detector detects the firing of the blank round(s) and simultaneously energizes a laser diode in the SAT which emits an infrared laser beam toward the target which is in the conventional sights of the weapon. Vehicles such as the HUM-VEE and tanks are also fitted with laser detectors for detecting infrared laser "artillery shell" hits. Soldiers and vehicles carry player units and control systems which include a microprocessor based control circuit for processing the signals from the detectors to determine if there has been a hit, the type of weapon registering the hit, and the identity of the shooter. After performing casualty assessment, the control circuit provides status information to the player, indicating on a display whether the player has been "killed", "injured" or "damaged". This in turn will tell the player his or her status in the combat training exercise. The exercise events and casualties are recorded, replayed and analyzed in detail during "after action reviews" (AARs).

In order to accurately assess the performance of soldiers during MILES-based combat training exercises it is essential that the laser detectors on the soldiers and vehicles accurately detect laser hits. Normally these detectors are equipped with a transparent window or lens that receives the infrared laser beam emitted by SAT-equipped rifle or a laser scanner transmitter on a tank gun. The infrared radiation passes through this optical element and impinges upon an infrared detector. If the window or lens is contaminated, e.g. with dirt, dust, mud or other debris, a laser hit may not be detected. A serious problem in MILES-based training exercises occurs because soldiers on occasion have been known to intentionally spread dirt, dust, mud, snow, shoe polish, or other contaminants on the window or lens of the detectors the player is wearing, or on the detectors mounted on his or her vehicle. These contaminants substantially limit or block the transmission of laser signals through the window or lens. This greatly reduces the likelihood, and in some cases completely eliminates the possibility, that they will be "killed" thereby keeping them in the war game, and inaccurately reflecting their combat performance. Such incidences greatly impede the commander's ability to accurately assess during an AAR the skill of the individual participants and the tactics employed. Accordingly there is an acute need to prevent unintentional and intentional fouling of these optical detectors. Any improvement in this regard must be designed to bar soldiers from overcoming the same.

SUMMARY OF THE INVENTION

Accordingly, it is the primary object of the present invention to provide an improved channel for processing signals from an optical detector used in simulated combat exercises.

Another object of the present invention is to provide a method of preventing soldiers from cheating during MILES-based training exercises and similar laser combat training exercises by deliberately contaminating the window, lens or cover of a soldier worn, or vehicle borne, laser optical detector.

In accordance with the present invention, an optical system for detecting contamination includes a detector mounted in a housing for detecting incident optical radiation having a predetermined wavelength and for generating signals representative thereof An optical element is mounted to the housing for allowing optical radiation received from an exterior side of the optical element to pass through the optical element and impinge upon the detector. A source or a plurality of sources of illumination may be mounted inside the housing for selectively illuminating the optical element from an interior side thereof with optical radiation having the same predetermined wavelength. A test circuit is connected to the detector for determining the presence of a predetermined amount of a contaminant on an exterior surface of the optical element based on the signals generated by the detector when the optical element is illuminated by radiation from the source of illumination.

The present invention also provides a method of preventing cheating in a simulated combat exercise. The method involves the first step of equipping a plurality of players with laser detectors for detecting simulated kills or injuries from SAT-equipped small arms weapons. The next step of the method involves electronically determining the presence of a contaminant on an exterior surface of an optical element positioned in front of a laser detector. The final step of the method involves providing an indication to a player if the contaminant is detected.

DETAILED DESCRIPTION OF THE PREFERRED EMBODIMENTS

Figure 1:
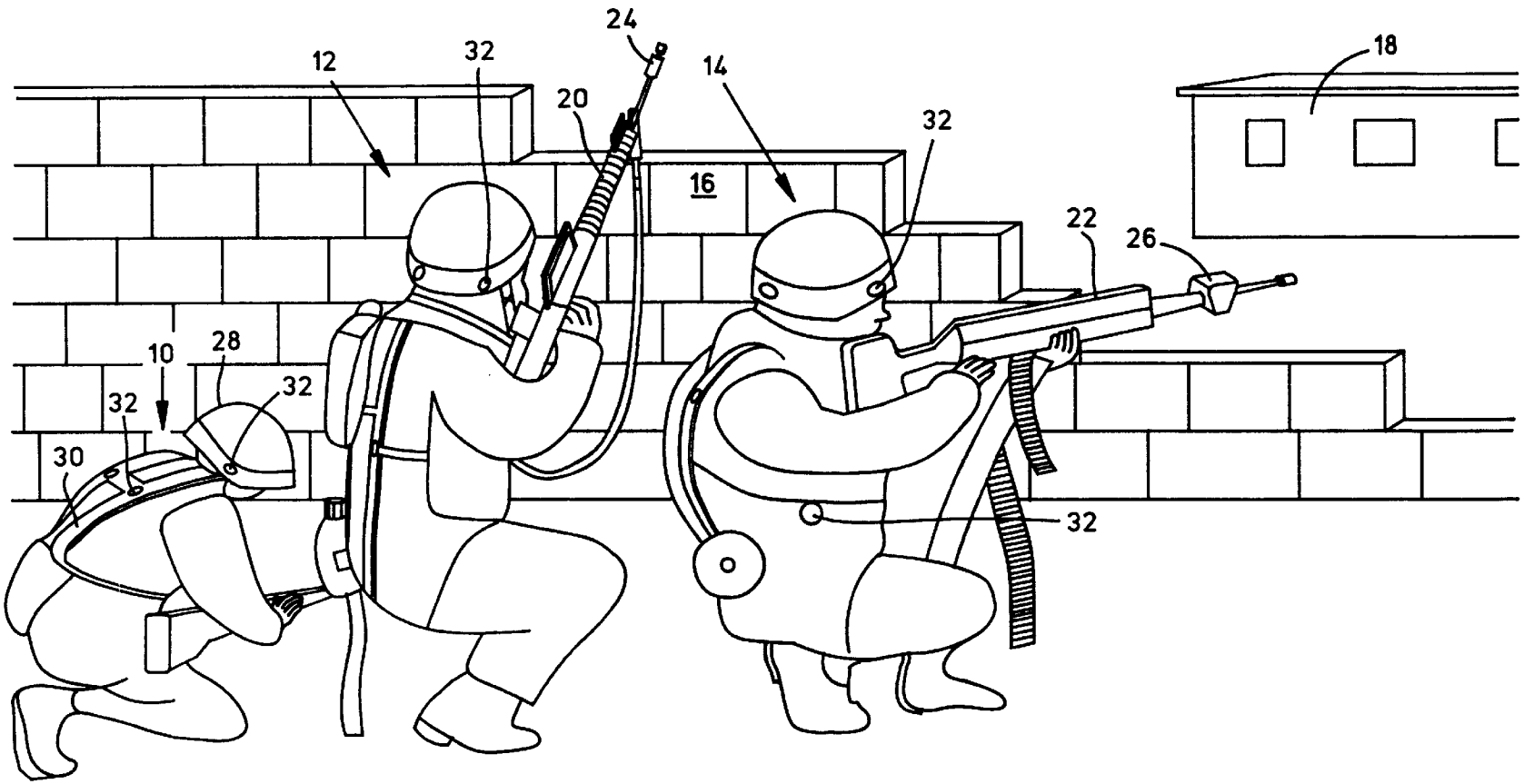
FIG. 1 illustrates three soldiers wearing infrared detectors participating in a MILES-based combat training exercise using SAT-equipped weapons.

FIG. 1 illustrates three lightly armed soldiers 10, 12 and 14 taking cover behind a block wall 16 and assaulting a building 18 sheltering armed hostiles a short distance away. The soldiers 12 and 14 are shown holding small arms weapons 20 and 22 each equipped with MILES SATs 24 and 26, respectively. The weapon 20 is an M16A2 assault rifle and the weapon 22 is an M249 squad automatic weapon. While a portion of a military commando unit has been illustrated in FIG. 1, it should be understood that police officers and other law enforcement personnel could participate in similar SAT-based training exercises.

Each of the soldiers, such as soldier 10, wears a helmet 28 and an H-shaped vest 30 equipped with sets of disk-shaped optical detectors 32 which detect infrared radiation that impinges thereon representing a MILES casualty or near miss fired by the SAT of a hostile hold up inside the building 18. The casualty could be a kill or an injury of a predetermined severity that could impede mobility, for example. The infrared radiation is preferably emitted by a semi-conductor laser diode inside a SAT at an optical wavelength of approximately nine hundred and four nanometers or longer wavelengths. By way of example, the SATs 24 and 26 may be constructed in accordance with the SAT disclosed in U.S. Pat. No. 5,476,385 granted Dec. 19, 1995 naming Himanshu N. Parikh et al. as co-inventors and entitled "Laser Small Arms Transmitter", the entire disclosure of which is hereby incorporated herein by reference. The aforementioned U.S. Pat. No. 5,476,385 is assigned to Cubic Defense Systems, Inc., the assignee of the subject application. See also pending U.S. patent application Ser. No. 09/596,674 filed Jun. 19, 2000 naming Deepak Varshneya et al. as co-inventors and entitled "Low Cost Laser Small Arms Transmitter and Method of Aligning Same", the entire disclosure of which is hereby incorporated herein by reference. The aforementioned pending U.S. patent application is also assigned to Cubic Defense Systems, Inc.

Each soldier carries a player unit (not illustrated in FIG. 1) which is connected to his or her infrared detectors 32 (FIG. 1) and logs MILES events into its memory according to the time they occurred such as a casualty and a near miss, along with the shooter's identity (PID code) and weapon type which are encoded on the infrared laser beam of the shooter's SAT. By way of example, the player units carried by the soldiers that connect to the infrared detectors 32 may be constructed in accordance with the electronic assembly disclosed in U.S. Pat. No. 5,426,295 granted Jun. 20, 1995 naming Himanshu N. Parikh et al. as co-inventors and entitled "Multiple Integrated Laser Engagement System Employing Fiber Optic Detection Signal Transmission", the entire disclosure of which is hereby incorporated herein by reference. The aforementioned U.S. Pat. No. 5,426,295 is also assigned to Cubic Defense Systems, Inc. A conventional MILES player unit is sometimes referred to as a digital player control unit (DPCU).

Figure 2:
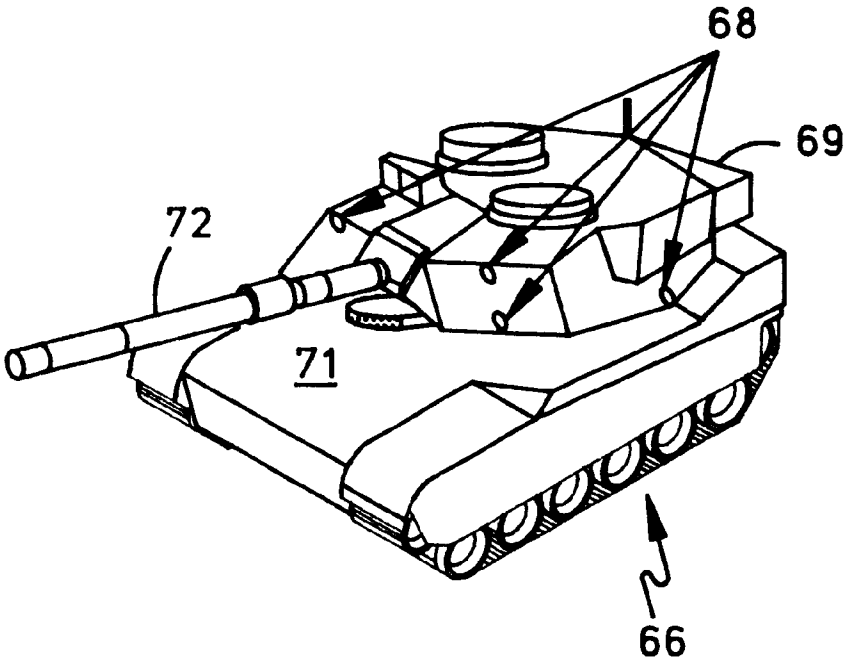
FIG. 2 illustrates a tank equipped with infrared laser detectors so that it can participate in MILES-based combat training exercises.

FIG. 2 illustrates a tank 66 such as an M1 A1 Abrams tank equipped so that it can participate in a MILES-based combat training exercise. A plurality of infrared detectors 68 are secured to the turret 69 of the tank 66. Each of the detectors 68 is wired to an onboard control system (not illustrated) mounted in either the turret 69 or the hull 71 of the tank 66. The turret 69 is stabilized and supports a cannon or tank gun 72 that is normally capable of firing high velocity tank killing artillery rounds.. The detectors 68 are spaced to detect a laser scan or simulated laser artillery round from all angles likely to be encountered by the tank 66 while on the battlefield. The signals generated by the infrared detectors 68 thus represent a "hit" when processed by the onboard control system.

Figure 3:
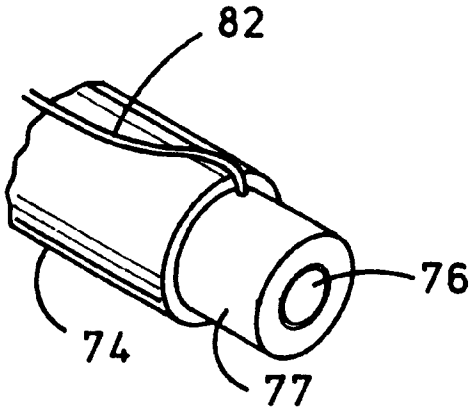
FIG. 3 is an enlarged view of the muzzle of the gun of the tank of FIG. 2 illustrating a laser scanner transmitter, GPS antenna and data link antenna supported in the muzzle to enable simulated gunnery practice.

FIG. 3 illustrates the muzzle 74 of the gun 72 of the tank 66. A laser scanner transmitter 76 is mounted on a removable mounting cylinder 77 secured in the bore of the muzzle 74. A cable 82 operatively connects the laser scanner transmitter 76 to the onboard control system. The tank 69 can fire a simulated artillery round at another tank or other vehicle such as a HUM-VEE or Bradley troop carrier also equipped with infrared detectors. The ballistic fly-out and trajectory are calculated to determine if there has been a bit. Further details of a gunnery training system employing the arrangements illustrated in FIGS. 2 and 3 may be found in pending U.S. patent application Ser. No. 09/534,773 filed Mar. 24, 2000 naming Deepak Varshneya et al. as co-inventors and entitled "Precision Gunnery Simulator System," now U.S. Pat. No. 6,386,879 B1 the entire disclosure of which is hereby incorporated by reference. The aforementioned pending U.S. patent application is also assigned to Cubic Defense Systems, Inc.

Figure 4:
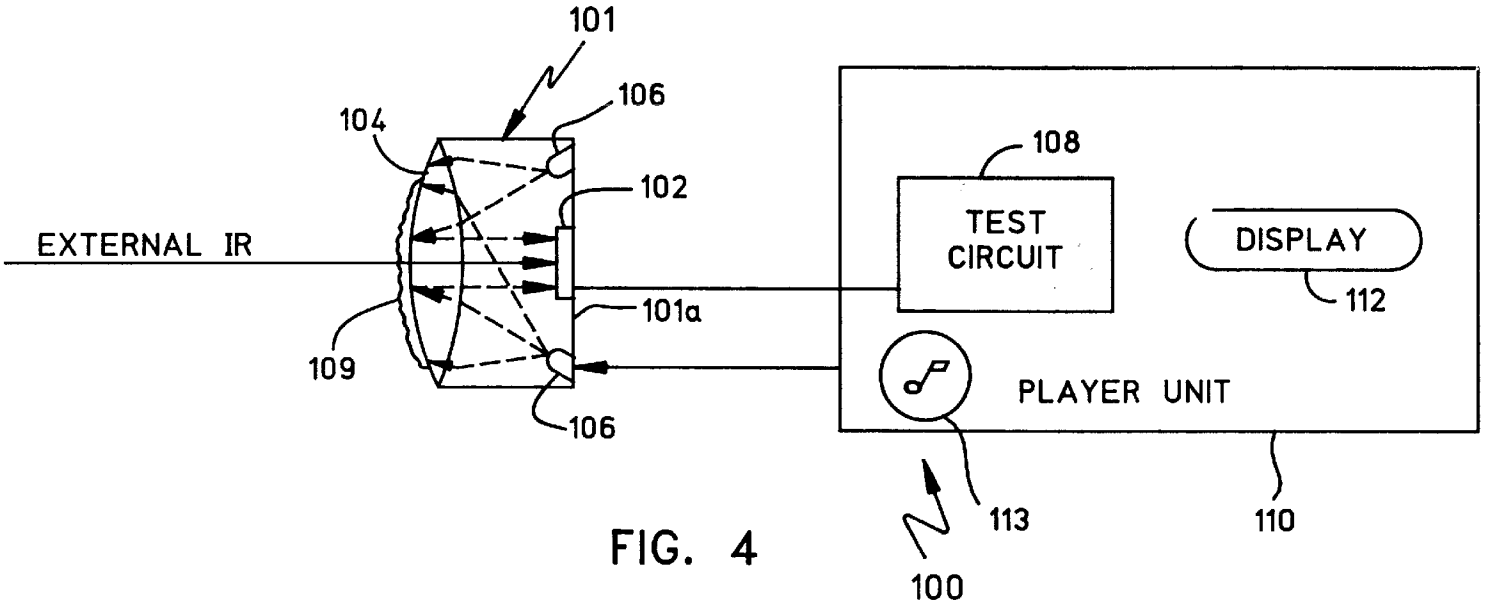
FIG. 4 is a diagrammatic illustration of an optical system for detecting contamination on the optical elements of the infrared detectors worn by the soldiers in FIG. 1 and carried by the tank in FIG. 2.

FIG. 4 is a diagrammatic illustration of an optical system 100 for detecting contamination on the optical elements of the infrared detectors 32 (FIG. 1) and 68 (FIG. 2). A generally cylindrical outer housing 101 surrounds and protects a semi-conductor infrared optical detector 102. The detector 102 is mounted in the housing 101 for detecting incident optical radiation having a predetermined wavelength (infrared in this example) and for generating electrical signals representative thereof A transparent optical element 104 in the form of a lens is mounted to circular open front end of the housing 101. The optical element 104 environmentally protects the delicate semi-conductor detector 102 while allowing infrared radiation received from an exterior side of the optical element 104, e.g from the SATs 24 and 26 or the laser scanner transmitter 76, to pass through the optical element 104 and impinge upon the detector 102. This infrared radiation is illustrated by the solid arrow labeled EXTERNAL IR in FIG. 4. A source of illumination, and more preferably a plurality of sources of radiation in the form of infrared LEDs 106 are mounted inside the housing 101 for selectively illuminating the optical element 104 from an interior side thereof with infrared radiation having the same predetermined wavelength as that emitted by the SATs 24 and 26 and the laser scanner transmitter 76.

A test circuit 108 (FIG. 4) is connected to the detector 102 for determining the presence of a predetermined amount of a contaminant illustrated as wiggled line 109 on a forward facing exterior surface of the optical element 104 based on the signals generated by the detector 102 when the optical element 104 is illuminated by radiation from the LEDs 106. Since the detector 102 is mounted in the center of the circular rear wall 101*a* of the housing 101, the LEDs 106 should be aimed or inclined so that their infrared radiation covers substantially the entire interior surface of the optical element 104. The test circuit 108 is part of a battery powered player unit 110 that includes an LCD or other display 112 for indicating the detection of the contaminant 109 on the exterior surface of the optical element 104. The LEDs 106 are energized at the appropriate times with a suitable electrical signal from the player unit 110. It will be understood, of course, that the detector 102 and LEDs 106 could be operatively connected to a similar test circuit in the onboard control system of a gunnery simulator. The test circuit 108 could be a dedicated circuit, but more preferably, it is provided by the combination of a specialized computer program in the form of firmware that is executed by the existing microprocessor of the player unit 110 or the onboard gunnery control system. The test circuit 108 thus provides a channel for detecting contamination on the lens, window or cover that forms the optical element 104 through which radiation is detected by the detector 102.

In FIG. 4, light from the LEDs 106 is illustrated in phantom lines radiating a rearward facing interior surface of the optical element 104, passing through the optical element 104 and then reflecting and/or scattering rearwardly from the contaminant covered exterior surface back to the detector 102. Each time there is an interface in medium, such as between the ambient air and the interior surface of the optical element 104 and between the ambient air and the exterior surface of the optical element 104, a certain amount of reflection will occur. Where the optical element 104 is made of glass, without any contamination, each interface of the optical element 104 may produce, for example, approximately 3.6 percent reflection for a total reflection of over seven percent.

The amount of reflection that would otherwise occur at the two interfaces of the two sides of the optical element 104 with the ambient air can be substantially reduced by coating each surface with an anti-reflection (AR) composition that reduces reflectivity. For example, where the optical element 104 is glass, both its forward and rearward facing surfaces may be coated with a dichroic material such as magnesium fluoride, which reduces its reflectivity to less than 0.5 percent. The use of AR coatings on both surfaces of the optical element 104 provides an additional advantage of ensuring that a maximum amount of the EXTERNAL IR (FIG. 4) radiation from a SAT or a laser scanner transmitter of a tank or other source is detected by the detector 102.

Where both surfaces of the optical element 104 are clean, a minimum amount of infrared radiation from the LEDs 106 will be reflected back to the detector 102. It may be necessary to mount the LED inside of a tiny shield, deflector or reflector (not illustrated) to prevent the direct transmission of infrared radiation to the detector 102. If the exterior surface of the optical element 104 is contaminated by dirt, dust, mud, snow, shoe polish or other contaminant, the contaminant will produce surface light scattering on the order of at least ten percent and more typically between about ten and fifteen percent. This is much greater than about one half percent that will be detected by the detector 102 when the exterior AR coated surface of the optical element 104 is clean of contaminant.

The player unit 110 can turn the LEDs 106 ON and have the test circuit 108 perform a contaminant determination algorithm when, for example, the player unit 110 is first powered up. In addition, or as an alternative, the player unit 110 may check for contaminant by energizing the LEDs 106 in accordance with a pre-programmed schedule. During each built-in-test (BIT), if the scattered light signal exceeds a predetermined minimum threshold, the player unit 110 can display a graphic flag or alphanumeric warning to the player indicating that contamination of the optical element 104 has been detected. If the contaminant is not remove within a pre-determined time after the warning, the player unit 110 can execute a kill command which will be indicated to the player on the display 112. At this time, the player's participation in the combat training exercise will be terminated to prevent him or her from cheating. The player unit 110 includes a speaker, buzzer or other transducer 113 for generating audible tones indicating a kill, injury, and a near miss upon detection of a laser bullet, and for further generating a "dirty detector" warning and a "kill command" elicited by a failure to clean the optical element 104 upon receipt of the "dirty detector command". The player unit 110 can have a GPS module and an RF transceiver (not illustrated) for receiving position location data and sending status and location information to a central command post. These features permit, along with additional on-board programming in the player unit 110, the simulation of minefields, indirect artillery fire such as mortars, and other area weapons effects. See U.S. Pat. No. 6,254,394 granted Jul. 3, 2001 naming Robert L. Draper et al. as co-inventors and entitled "Area Weapons Effect Simulation System and Method", the entire disclosure of which is hereby incorporated by reference. The latter patent is also assigned to Cubic Defense Systems, Inc.

It should be understood that while I have described my system in terms of interfacing with a player unit worn by a soldier, it is more preferably applicable to the onboard control system of a tank or other vehicle that receives inputs from many infrared detectors mounted to the exterior of the vehicle. The elegance and economy of my design is exhibited by the fact that it may be implemented with only a pair of very low cost infrared LEDs 106 being added to the existing housing and detector assemblies now in use in MILES systems, along with computer programming that can be easily added to a player unit 110 or to an onboard control system of a MILES-equipped vehicle. The version of my system illustrated in FIG. 4 cannot be easily defeated by a soldier during war games because the principal physical component, namely the infrared LEDs 106 are concealed and hidden from the soldier within the sealed protective outer housing 101. The programming in the player unit 110 can be written so that attempts to tamper with the internal components inside the housing 101 will result in an automatic kill command being executed. For example, a simple switch (not illustrated) could be incorporated inside the housing 101 so that upon the opening thereof, the switch would be closed, causing the execution of the automatic kill command.

Figure 5:
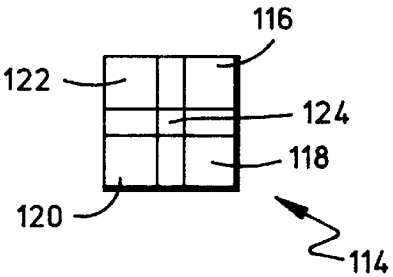
FIG. 5 is an enlarged diagrammatic plan view of a quad-detector and LED assembly that may be utilized in the system of FIG. 4.

Problems with aiming the LEDs 106 or shielding them from the detector 102 can be reduced by using a quad-detector and LED assembly 114 as illustrated in FIG. 5. The assembly 114 comprises four separate semi-conductor infrared laser detectors 116, 118, 120 and 122 and a centrally positioned infrared LED 124. The LED 124 may be recessed or mounted within a ferrule to eliminate direct transmission of light to the four detectors.

Figure 6:
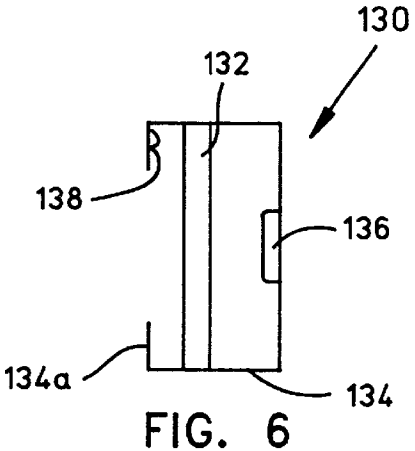
FIG. 6 is a diagrammatic illustration of a portion of an alternate embodiment of a system for detecting contamination on the optical element of an infrared detector in which the optical element is illuminated from the exterior side thereof

FIG. 6 illustrates an alternate embodiment 130 in which an optical element in the form of a flat transparent window 132 is illuminated during a test from the forward facing exterior side thereof A cylindrical outer protective housing 134 encloses an infrared laser detector 136 which is positioned behind the window 132. The housing 134 has a radially inwardly directed flange 134*a* which supports a rearwardly facing infrared LED 138 that illuminates the exterior surface of the window 132. If the exterior surface of the window 132 has sufficient contaminant covering the same, the resulting light scattering will be detected by the test circuit 108 when it processes the signals generated by the detector 136 and compares them to a stored base line.

It will thus be understood by those skilled in the art that the system of FIG. 4 can be used to provide a method of preventing players from cheating during a MILES-based combat training exercise. The method includes the initial step of equipping a plurality of players such as soldiers 12 and 14 (FIG. 1) with laser detectors 32 for detecting simulated kills and injuries from SAT-equipped small arms such as 20 and 22. The method further includes the step of electronically determining the presence of a contaminant 109 (FIG. 4) on an exterior surface of an optical element 104 positioned in front of a laser detector 102 by illuminating an exterior surface of the optical element 104 from an interior side of the optical element 104 with a source of radiation 106 having a wavelength similar to that of a radiation beam emitted by the SATs 24 and 26 attached to the small arms weapons 20 and 22. The method further includes the step of providing a warning to a player via player unit 110 and its display 112 that the contaminant 109 has been detected. While not necessary, the method preferably includes the additional step of generating a kill command if the detected contaminant 109 is not cleaned from the exterior surface of the optical element 104 within a predetermined amount of time, such as five minutes, following the warning to the player.

While I have described preferred embodiments of my optical contamination detecting system and a method of prevent cheating in MILES-based combat training exercises, it should be apparent to those skilled in the art that my invention may be modified in both arrangement and detail. For example the energy emitted by the SATs and the laser tank guns need not be in the infrared range. The AR coatings are not absolutely necessary although they enhance the reliability and sensitivity of my system and allow smaller degrees or amounts of contamination to be accurately detected. My system could be calibrated to be sensitive to various levels and types of contaminant, and its computer program written to detect various threshold levels and types of contaminant. This could be readily accomplished by customizing the firmware executed by the player unit 110. My system and method can be applied to a training exercise having only soldiers, only vehicles, or a combination of the two. The optical element may comprise a window or protective cover, a lens, or a lens and a window or protective cover over the lens. The housing that supports the detector 102 need not have a hollow interior but could be solid or laminated, or any other support structure for holding this delicate semi-conductor device. Therefore, the protection afforded our invention should only be limited in accordance with the scope of the following claims. Soldiers, law enforcement personnel and vehicles adorned with detectors are collectively referred to in the claims as "players."

I claim:

1. An optical system for detecting contamination to prevent cheating in a simulated combat exercise, comprising:

a housing;

a detector mounted in the housing for detecting incident optical radiation having a predetermined wavelength and for generating signals representative thereof;

an optical element mounted to the housing for allowing optical radiation received from an exterior side of the optical element to pass through the optical element and impinge upon the detector;

a source of illumination mounted inside the housing for selectively illuminating the optical element from an interior side thereof with optical radiation having the predetermined wavelength;

test circuit means connected to the detector for determining the presence of a predetermined amount of a contaminant on an exterior surface of the optical element based on the signals generated by the detector when the optical element is illuminated by radiation from the source of illumination; and means connected to the circuit means for providing an indication to a player that the predetermined amount of the contaminant has been detected on the exterior surface of the optical element.

2. The optical system of claim 1 wherein the optical element is selected from the group consisting of a transparent window and a transparent lens.

3. The optical system of claim 1 wherein the detector is an infrared detector and the source of illumination is an infrared light emitting diode.

4. The optical system of claim 2 wherein an interior surface of the optical element is coated with a material that reduces reflection of the optical radiation.

5. The optical system of claim 4 wherein the material a dichroic material.

6. The optical system of claim 2 wherein the test circuit means allows a predetermined amount of time to clean the exterior surface of the optical element of the detected contaminant and effectuates a cheat-kill command if the presence of the predetermined amount of the contaminant on the exterior surface of the optical element is detected upon the expiration of the predetermined amount of time.

7. The optical system of claim 2 wherein the test circuit means resides in a player unit.

8. An optical system for detecting contamination to prevent cheating in a simulated combat exercise, comprising:

a housing;

a detector mounted in the housing for detecting incident optical radiation having a predetermined wavelength and for generating signals representative thereof;

an optical element mounted to the housing for allowing optical radiation received from an exterior side of the optical element to pass through the optical element and impinge upon the detector;

a source of illumination mounted inside the housing for selectively illuminating the optical element from an interior side thereof with optical radiation having the predetermined wavelength;

test circuit means connected to the detector for determining the presence of a predetermined amount of a contaminant on an exterior surface of the optical element based on the signals generated by the detector when the optical element is illuminated by radiation from the source of illumination; and wherein the test circuit means includes means for determining an identity of a shooter and a type of weapon based on information encoded in a beam of the radiation tired from a small arms weapon or a tank gun that passes through the optical element and impinges on the detector.

9. An optical system for detecting contamination to prevent cheating in a simulated combat exercise, comprising:

a housing;

a detector mounted in the housing for detecting incident optical radiation having a predetermined wavelength and for generating signals representative thereof;

an optical element mounted to the housing for allowing optical radiation received from an exterior side of the optical element to pass through the optical element and impinge upon the detector;

a source of illumination mounted inside the housing for selectively illuminating the optical element from an interior side thereof with optical radiation having the predetermined wavelength;

test circuit means connected to the detector for determining the presence of a predetermined amount of a contaminant on an exterior surface of the optical element based on the signals generated by the detector when the optical element is illuminated by radiation from the source of illumination; and wherein the test circuit means periodically determines the presence of the predetermined amount of the contaminant on the exterior surface of the optical element.

10. A method of preventing cheating in a simulated combat exercise, comprising the steps of:

equipping a plurality of players with laser detectors for detecting simulated kills or injuries from SAT-equipped small arms weapons;

electronically determining the presence of a contaminant on an exterior surface of an optical element positioned in front of a laser detector; and providing an indication to a player if the contaminant is detected.

11. The method of claim 10 wherein the step of determining the presence of the contaminant on exterior surface of the optical element is repeatedly performed in accordance with a predetermined schedule.

12. The method of claim 11 wherein the step of determining the presence of the contaminant on the exterior surface of the optical element is performed by illuminating an exterior surface of the optical element with a source of radiation having a wavelength similar to that of a radiation beam emitted by a SAT attached to a small arms weapon.

13. The method of claim 12 wherein the exterior surface of the optical element is illuminated from an interior side of the optical element.

14. The method of claim 13 wherein an interior surface of the optical element is coated with a material that reduces its reflectivity.

15. The method of claim 11 wherein the step of determining the presence of the contaminant on exterior surface of the optical element is performed by sensing and increase in light scattering of at least ten percent.

16. The method of claim 11 and further comprising the step of providing a warning to a player that the contaminant has been detected and must be removed in order to continue participating in the combat training exercise.

17. The method of claim 16 and further comprising the step of generating a kill command if the detected contaminant is not cleaned from the exterior surface of the optical element within a predetermined amount of time following the warning to the player.

18. The method of claim 11 wherein the contaminant is selected from the group consisting of dirt, dust, mud, snow and shoe polish.

19. A method of preventing cheating in a simulated combat exercise, comprising the steps of:

equipping a plurality of players with laser detectors for detecting simulated kills or injuries from SAT-equipped small arms weapons;

electronically determining the presence of a contaminant on an exterior surface of an optical element positioned in front of a laser detector by illuminating an exterior surface of the optical element from an interior side of the optical element with a source of radiation having a wavelength similar to that of a radiation beam emitted by a SAT attached to a small arms weapon;

providing a warning to a player that the contaminant has been detected; and generating a kill command if the detected contaminant is not cleaned from the exterior surface of the optical element within a predetermined amount of time following the warning to the player.

* * * * *